US005570174A

United States Patent [19]

Loce

[11] Patent Number: 5,570,174

[45] Date of Patent: Oct. 29, 1996

[54] TWO-PASS HIGHLIGHT COLOR COPIER EMPLOYING CAD SCAVENGELESS DEVELOPMENT & STRONG DEVELOPMENT POTENTIALS

[75] Inventor: Robert P. Loce, Rochester, N.Y.

[73] Assignee: Xerox Corporation, Stamford, Conn.

[21] Appl. No.: 301,922

[22] Filed: Sep. 1, 1994

[51] Int. Cl.[6] ..... G03G 15/01

[52] U.S. Cl. ..... 355/328; 355/326 R

[58] Field of Search ..... 355/71, 210, 326 R, 355/327, 328

[56] References Cited

U.S. PATENT DOCUMENTS

| | | | |
|---|---|---|---|
| 3,832,170 | 8/1974 | Nagamatsu et al. | 430/46 |
| 4,068,938 | 1/1978 | Robertson | 355/326 R |
| 4,078,929 | 3/1978 | Gundlach | 430/42 |
| 4,189,224 | 2/1980 | Sakai | 355/326 R |
| 4,264,185 | 4/1981 | Ohta | 355/326 R |
| 4,335,194 | 6/1982 | Sakai | 430/42 |
| 4,398,816 | 8/1983 | Nakajima et al. | 355/328 X |
| 4,479,242 | 10/1984 | Kurata | 382/17 |
| 4,509,850 | 4/1985 | Weigl | 355/328 |
| 4,562,129 | 12/1985 | Tanaka et al. | 430/42 |
| 4,588,667 | 5/1986 | Jones et al. | 430/73 |
| 4,654,284 | 3/1987 | Yu et al. | 430/59 |
| 4,780,385 | 10/1988 | Wieloch et al. | 430/58 |
| 4,922,298 | 5/1990 | Folkins et al. | 355/328 X |
| 4,937,636 | 6/1990 | Rees et al. | 355/328 |
| 5,089,847 | 2/1992 | Folkins | 355/328 X |
| 5,162,821 | 11/1992 | Fukuchi et al. | 355/326 R |
| 5,172,170 | 12/1959 | Hays et al. | 355/259 |
| 5,329,346 | 7/1994 | Suzuki et al. | 355/326 R |

*Primary Examiner*—Robert Beatty

[57] ABSTRACT

A two-pass light/lens highlight color copier in which high contrast images are created providing relatively large development fields or potentials compared to those associated with tri-level imaging. The imaging system disclosed has a conventional light lens imaging or exposure station, one Charged Area Development (CAD) subsystem including positively charged black toner, and one CAD scavengeless development subsystem including a positively charged highlight color toner. Other subsystems normally found in the xerographic imaging environment, such as charging, exposure, transfer and fusing are also employed. A high contrast CAD image is formed in the first pass using conventional Light/Lens scanning optics. A spectral filter is used with the Light/Lens optics during a second pass for forming a highlight color image.

8 Claims, 4 Drawing Sheets

TWO-PASS HIGHLIGHT COLOR COPIER EMPLOYING CAD SCAVENGELESS DEVELOPMENT & STRONG DEVELOPMENT POTENTIALS

BACKGROUND OF THE INVENTION

This invention relates generally to the creation of highlight color images and more particularly to the use of light lens imaging techniques for such purposes.

The invention can be utilized in the art of xerography. In the practice of conventional xerography, electrostatic latent images are formed on a charge retentive surface such as a photoreceptor by first uniformly charging the photoreceptor. The charge is selectively dissipated in accordance with a pattern of activating radiation corresponding to original images. The selective dissipation of the charge leaves a latent charge pattern on the imaging surface corresponding to the areas not exposed by radiation. The areas of charge dissipated on the photoreceptor correspond to residual or background voltage levels. Thus, the photoreceptor contains two voltage levels in the case of a binary digital system. In the case of a light/lens system a whole array of voltage levels are present on the photoreceptor. This latent charge pattern is rendered visible by developing it with toner. The toner is generally a colored powder which adheres to the charge pattern by electrostatic attraction. The developed image is then fixed to the imaging surface or is transferred to a receiving substrate such as plain paper to which it is fixed by suitable fusing techniques.

Many documents and printed materials consist of black, white (color of substrate) and one highlight color. It is a very important and formidable task to print and copy these documents.

U.S. Pat. No. 4,937,636 granted to Rees et al describes one technique that involves tri-level imaging in a light lens copier. In that patent, an original to be copied is modified using fluorescent ink on selected portions thereof. Light reflected from the modified original is transmitted through a colored filter and is projected onto the surface of a monopolar photoreceptor. Light incident on the fluorescent ink is absorbed over a specific wavelength range and is re-admitted at a higher wavelength. This light, and light reflected from the white background, are transmitted through a filter of a color associated with the re-emitted wavelength. Light reaching the photoreceptor discharges charged areas thereon at two energy levels. The resulting latent image incorporates three separate discharge levels corresponding to the black image information, color fluorescent areas, and background areas. The black and color areas are developed with appropriate colored toner by developer units biased at the appropriate levels. The requirement of modifying or creating an original using special inks presents a serious drawback to commercial acceptance of the process.

A commercially available printer (Xerox 4850) is capable of making highlight color prints in a single pass. That printer as in the case of the Rees device utilizes a technique know as tri-level imaging. Tri-level imaging splits the Photo-Induced-Discharge Curve (PIDC) thereby yielding low contrast images which allow only low development potentials. U.S. Pat. No. 4,078,929, R. Gundlach teaches the use of tri-level xerography as a means to achieve single-pass highlight color. In this scheme, the photoreceptor is initially charged to a voltage $V_0$. It is then selectively discharged with a single Raster Output Scanner (ROS) to approximately $V_0/2$ in the background (white) areas and to near zero or residual potential in the color areas.

It is well known in the art to produce two color output copies using a multi-pass system, a present commercial example being the Canon 3625 copier. For this type of system, an operator utilizes a mimic-type electronic edit pad to delineate areas of an original it is desired to highlight. The coordinates of a selected area are entered into machine memory. During a first exposure cycle all areas on the photoreceptor are erased save the selected highlight color area which is then subsequently developed with the appropriate color toner. The resulting image is transferred to a copy sheet, fused and returned to the developer station entrance zone where it is re-registered. A second exposure of the original is made and the highlight area only is erased. The resulting latent image is developed with conventional black toner, and transferred to the copy sheet which is then fused and the copy sheet conveyed to an output tray.

The type of system exemplified by the Canon 3625 has several disadvantages; it requires an expensive electronic component, the edit pad as well as additional memory. Registration following the first exposure is difficult to achieve. Since the system is two cycle (two pass) the productivity is limited, It is therefore highly desirable for an electrophotographic reproduction machine to reproduce both the black and the color (red for most highlighting purposes) information in a single pass. By single pass, it is meant that a composite electrostatic latent image having regions corresponding to the red information and black information is recorded on the photoconductive surface. This composite electrostatic latent image is developed with black and red toner particles to produce a two-color toner powder image. This two-color powder image is subsequently transferred to the copy sheet and permanently affixed thereto, In this way, a highlighted color copy of the original document may be readily produced at relatively high speeds, automatically and in perfect registration.

Following is a discussion of other prior art, incorporated herein by reference, which may bear on the patentability of the present invention. In addition to possibly having some relevance to the patentability thereof, these references, together with the detailed description to follow, may provide a better understanding and appreciation of the present invention.

U.S. Pat. No. 3,832,170 Nagamatsu et al., describes a photosensitive member having an insulating layer acting as a color filter. The photoconductive drum is divided into three segments, each segment corresponding to a different colored electrostatic latent image. These differently colored electrostatic latent images are then developed by toner particles complementary in color thereto. The toner powder images are then transferred to a copy sheet in superimposed registration to form a multicolor copy corresponding to the original document.

U.S. Pat. No. 4,078,929 Gundlach, discloses a reproduction machine which can form a two-color copy of an original document either using conventional light lens exposure techniques, or electronically. A charge pattern of a single polarity and having at least three different levels of potential is formed on a photoreceptor and developed in two colors by utilizing relatively negatively charged toner particles of one color and relatively positively charged toner particles of a second color. The exposure system requires the use of black and white images on an original document having a intermediate (grey) color.

U.S. Pat. No. 4,189,224 Sakai, discloses a photoconductive drum formed with first and second photoconductive layers of different spectral sensitivities. The photoconductive drum is charged and exposed causing electrostatic latent images to be formed on the respective layers according to the color within the original document. The charges of the latent images are of opposite polarity. Toner particles, similarly of opposite polarity, are used to develop the respective latent images. The toner particles of different colors. In this way, a two-color copy is formed.

U.S. Pat. No. 4,264,185 Ohta, describes an electrophotographic printing machine employing a photoconductive drum formed with at least two photoconductive layers of different spectral sensitivities. One layer may be panchromatic with the other layer being insensitive to red light. The drum is charged, at least twice, with opposite polarities to produce the charge pattern. A light image of the original document then exposes the charged regions of the drum. This results in positive and negative electrostatic latent images being recorded thereon. The latent images are developed with black and red toner particles of opposite polarity to form a two-color copy.

U.S. Pat. No. 4,335,194, Sakai, discloses a photoconductive member comprising a red sensitive photoconductive layer and a red-insensitive photoconductive layer. Two colors are printed by charging and exposing to white light, irradiating with red light and charging to an opposite polarity, charging to the same polarity as an opposite polarity, charging to the same polarity as the first polarity, and developing with red and black toners of opposite polarity.

U.S. Pat. No. 4,509,850, Weigl, teaches an electrophotographic printing machine capable of reproducing both black information and red information in a single pass. A continuously charged area and a modulated charged area are recorded onto a photoconductive surface. The modualted charged area is developed with polar or polarezable marking particles of a first color while the continuously charged area is developed with charged marking particles of a second color.

U.S. Pat. No. 4,479,242, Kurata, discloses a dichromatic reading device capable of separating a specific color from other colors of and original document. An electric circuit is provided which obtains the difference between the level of an image signal readout without a filter, and the level of a signal readout though a complementary filter for the specific color. Subsequently, an image signal for the specific color is produced from the difference.

U.S. Pat. No. 4,068,938, Robertson, teaches an electrophotographic printing machine capable of reproducing two-color copies from a two-color original document. A electrostatic latent image having three discrete potential levels is recorded onto a photoconductive drum. A high level is developed by particles of a first color corresponding to a dark color of the original document and a low level is developed by particles of a second color. The underdeveloped portion remains the color of the sheet of support material.

U.S. Pat. No. 4,562,129, Tanaka, discloses a bipolar photoreceptor which permits three different potential levels to be formed thereon.

From the discussion above it can be seen that those systems which utilize a single pass highlight color system (e.g. Gundlach) require the formation of separate and distinct levels of photoconductor charge. One level (high) corresponds to black information, intermediate level corresponds to white background and a third level (low) corresponds to the highlight color (red). The majority of the other prior art references cited above disclose some kind of bi-polar photoreceptor comprising multiple layers, each layer sensitive to a different color. The black and red discharge areas are then developed by developer units biased to appropriate levels. It would be desirable to enable a single pass color highlight system which does not require a bi-polar photoreceptor. It would also be desirable for the system to utilize a conventional light lens scanning system to make highlight color copies of originals having normal red and black images on a white background (unlike, for example, Gundlach which makes two color copies either from a CRT display or from an original with a grey background).

BRIEF SUMMARY OF THE INVENTION

According to the present invention, there is provided a two-pass light/lens highlight color copier in which large contrast images are created which provide relatively large development fields or potentials compared to those associated with tri-level imaging.

The imaging system disclosed herein has a conventional light lens imaging or exposure station, one Charged Area Development (CAD) subsystem including positively charged black toner, and one CAD scavengeless development subsystem including a positively charged highlight color toner. Other subsystems normally found in the xerographic imaging environment, such as charging, exposure, transfer and fusing are also employed. Since both development subsystems are CAD, and the toner is of the same sign, the pretransfer step required by tri-level xerography is not needed.

Spectral filtration or colored lamps form part of the exposure station. The overall system, being two-pass, necessitates recharge and re-exposure. The color development is turned off or cammed out of development range for the first pass. The black development subsystem is cammed out of range for the second pass. Transfer and clean are activated only for the second pass.

DETAILED DESCRIPTION OF THE PREFERRED EMBODIMENT OF THE INVENTION

Figure 6:
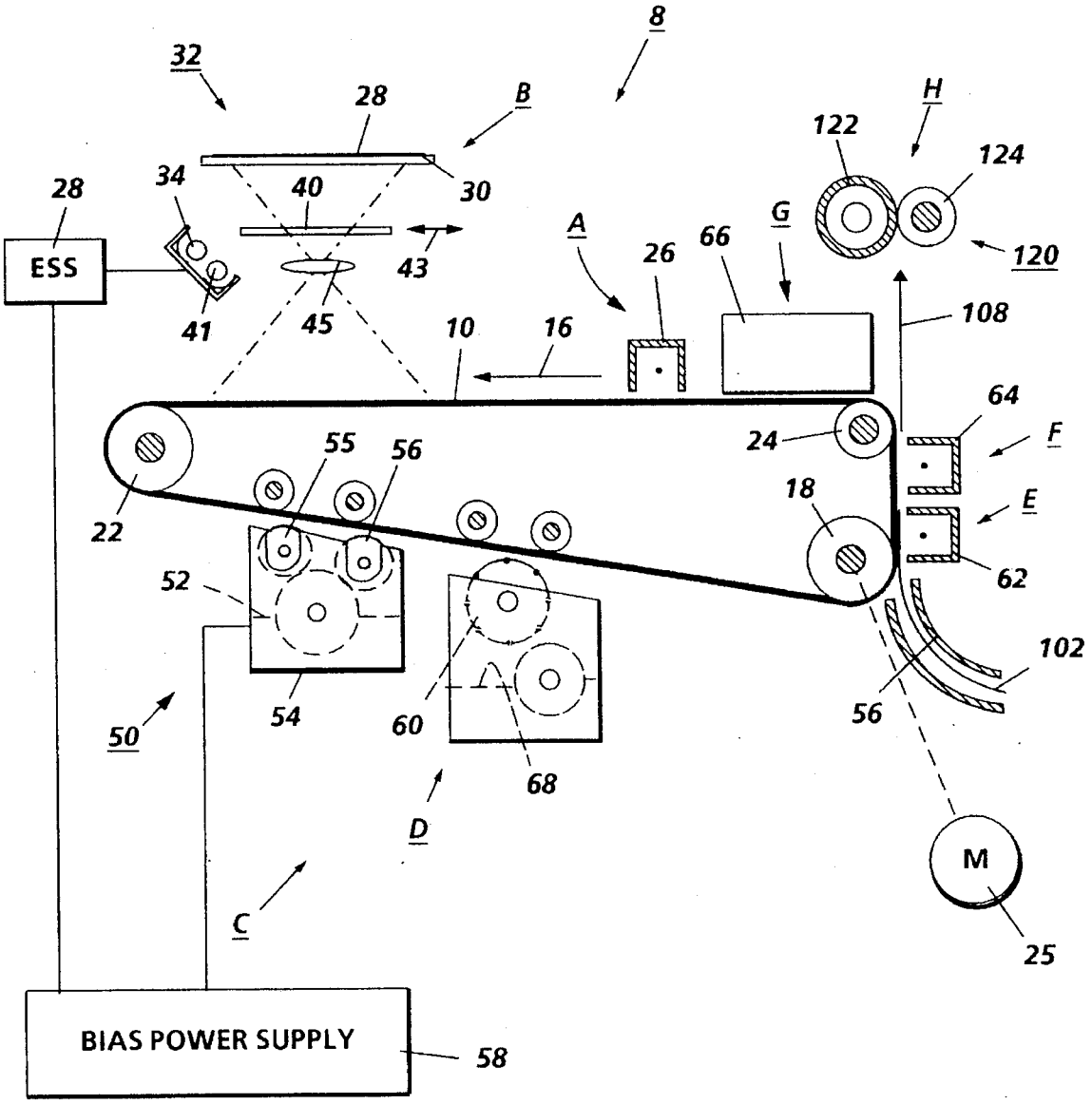
FIG. 6 discloses schematically a xerographic processor in which the present may be incorporated.

As shown in FIG. 6, a highlight color printing apparatus in which the invention may be utilized comprises a xerographic processor 8 including a charge retentive member in the form of an Active Matrix (AMAT) photoreceptor belt 10 which is mounted for movement in an endless path through a charging station A, an exposure station B, a first development station C, a second developer station D, a transfer station E, a Detack station F and a cleaning station G. Belt 10 moves in the direction of arrow 16 to advance successive portions thereof sequentially through the various processing stations disposed about the path of movement thereof. Belt 10 is entrained about a plurality of rollers 18, 22 and 24, the former of which can be used as a drive roller and the latter of which can be used to provide suitable tensioning of the photoreceptor belt 10. Motor 25 rotates roller 18 to advance belt 10 in the direction of arrow 16. Roller 18 is coupled to motor 25 by suitable means such as a belt drive, not shown. Typical belt photoreceptors are disclosed in U.S. Pat. No. 4,588,667, U.S. Pat. No. 4,654,284 and U.S. Pat. No. 4,780,385.

As will be apparent from consideration of FIG. 6, as successive portions of belt 10 pass through charging station A, a corona discharge structure comprising a corotron 26 charges the belt 10 to a selectively high uniform negative potential.

Next, the charged portions of the photoreceptor surface are advanced through exposure station B. At exposure station B, an original document 28 supported on a platen 30 is scanned using a Light Lens (L/L) optics arrangement indicated generally by reference character 32. The original document comprises, by way of example, black images plus one highlight color image. The photoreceptor, which is initially charged to a voltage $V_0$, (equal to about −800 volts) is exposed, in a first pass, using an exposure lamp 34 at the exposure station B thereby forming a CAD image 40 (FIG. 1) on the photoreceptor 10. Due to the combination of photoreceptor dark decay and the effects of L/L exposure the CAD image is reduced to a voltage level of about −700 volts. The high exposure serves to drive the white or background latent image 42 ($V_{Color}$) as well as the highlight color latent image 44 ($V_{White}$) down to residual voltage level of about −125 volts. Thus, the PIDC on the photoreceptor is driven down to the residual voltage (approximately−125 volts) in the areas corresponding to the white and color portions of the original.

Figure 1:
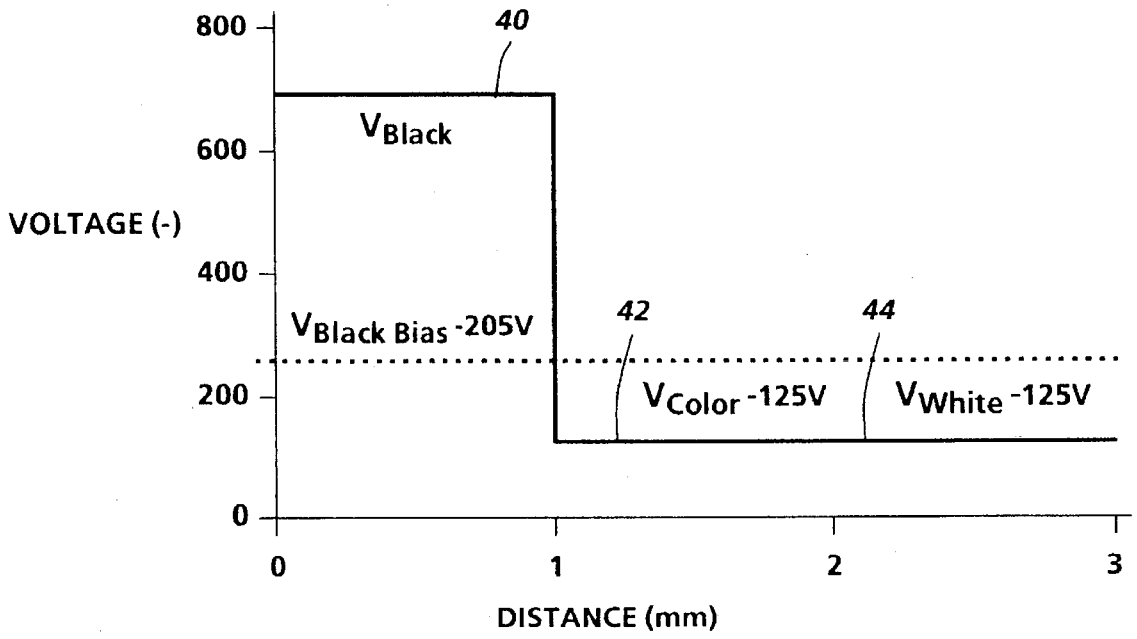
FIG. 1 is a plot of photoreceptor voltage versus distance or location on a photoreceptor.
Figure 2:
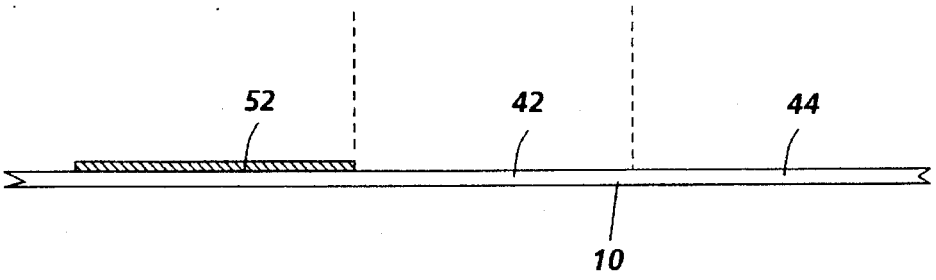
FIG. 2 is a schematic view of a photoreceptor following the development of a first image according to the invention.

At development station C (FIG. 6), a magnetic brush development system, indicated generally by the reference numeral 50 advances black developer material 52 contained in a housing structure 54 into contact with the CAD electrostatic latent image 40 on the photoreceptor 10. To this end the magnetic brush developer system 50 comprises a pair of magnetic brush rollers 55 and 56. A bias power supply 58 supplies a black or CAD voltage, $V_{Black\ Bias}$ equal to −250 volts (FIG. 1). This provides a relatively large development field (−450 volts) compared to those available with tri-level xerography. During development of the black CAD image, a CAD scavengeless developer device 60 used for developing the highlight color image is turned off. After development the photoreceptor appears as shown in FIG. 2. Thus, the CAD image area contains black developer 52 while the other areas of the photoreceptor remain undeveloped.

After development of the CAD image, a second pass of the photoreceptor through the xerographic processing stations, again moves it through the charging station A past the corotron 26 where it is recharged to approximately −800 volts. Such movement necessitates the inactivation of a transfer corotron 62, detack corotron 64, pre-clean corotron (not shown) and a cleaner device 66 while the photoreceptor is moved therepast. Such inactivation is effected using well known techniques for this purpose.

Figure 3:
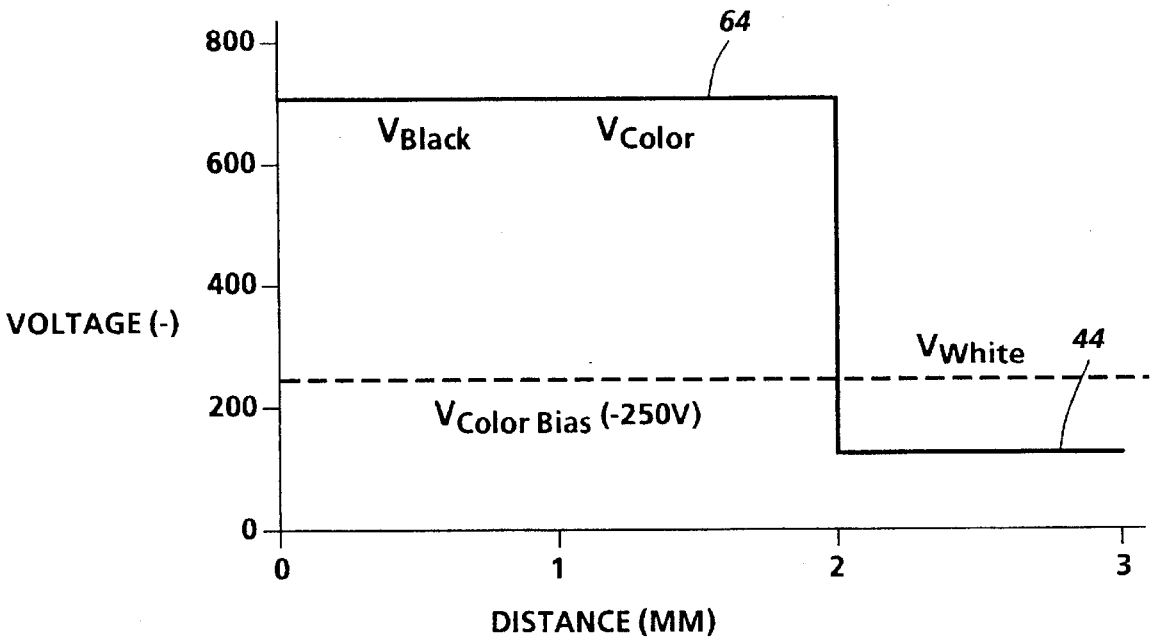
FIG. 3 is a plot of voltage versus photoreceptor image position following the formation of a second latent image.

At the exposure station B, a second imagewise exposure is effected using a filter structure 40 having suitable spectral attributes so that the color portion of the original appears as black on the photoreceptor. Alternatively, a suitable lamp structure could be used for this purpose. For example, with a blue highlight color contained in the original, a yellow filter 40 or lamp 41 is utilized. This exposure results in a photoreceptor voltage as indicated in FIG. 3 where the color portion of the original is represented by a latent CAD image 64. The voltage level of the black image 52 as well as the color image is approximately −700 volts by virtue of the recharging step followed by the combination of dark decay and stray light. The background voltage is again at approximately −125 volts after the second exposure step. During this portion of the imaging process, the filter 40 is adapted, in a well known manner, to be moved into the light path generated the optics 32. The filter is adapted to be moved in the direction of the arrow 43 for intercepting the reflected illumination from the document 28 prior to its passage through a lens 45 and impingement on the photoreceptor 10. In the case where the lamp 41 is used in lieu of the filter 40, an Electronic Subsystem (ESS) 46 serves to energize this lamp, deenergize the lamp 34 and move the filter 40 out of the optical path.

Figure 4:
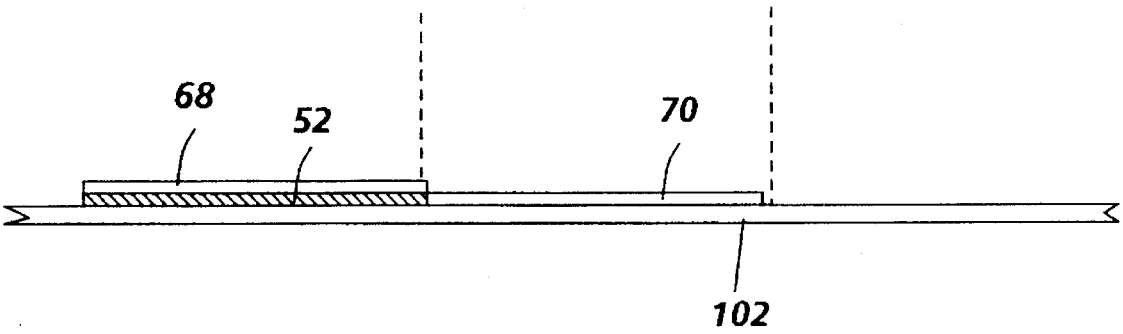
FIG. 4 depicts the appearance of a photoreceptor following development of a second image according to the invention.

Using the CAD scavengeless developer device 60 to develop the CAD images (black and color), causes the bare photoreceptor sites that are meant to be developed with colored toner (FIG. 4), as well as the black toner image to be developed with color toner 68 thereby forming colored image 70. The colored development subsystem will not be contaminated and the black image will not be disturbed by the positively charged color toner from the scavengeless developer device. A scavengeless developer device of the type disclosed in U.S. Pat. No. 5,172,170 granted to Hays et al on Dec. 15, 1992 may be utilized for the device 60. On the second pass the black development subsystem 50 is turned off or cammed out of range, depending on its type.

Subsequent to image development a sheet of support material 102 is moved into contact with the toner image at transfer station E. The sheet of support material is advanced to transfer station E by conventional sheet feeding apparatus comprising a part of the paper handling module, not shown. Preferably, the sheet feeding apparatus includes a feed roll contacting the uppermost sheet of a stack copy sheets, not shown. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station E.

Transfer station E includes the transfer corotron 62 which sprays negative ions onto the backside of sheet 102. This attracts the positively charged, black and highlight color toner powder images from the belt 10 to sheet 102. The detack corotron 64 is also provided for facilitating stripping of the sheets from the belt 10.

Figure 5:
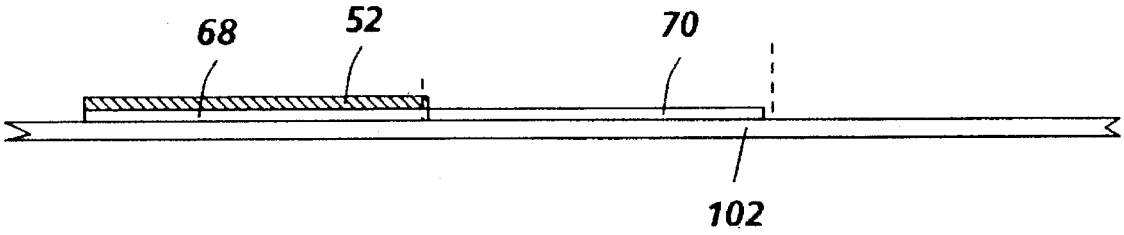
FIG. 5 depicts the appearance of a highlight color image according to the invention following transfer of the image to a final substrate.

After transfer, the sheet continues to move, in the direction of arrow 108, onto a conveyor (not shown) which advances the sheet to a fusing station H. Fusing station H includes a fuser assembly, indicated generally by the reference numeral 120, which permanently affixes the transferred powder image to sheet 102. Preferably, fuser assembly 120 comprises a heated fuser roller 122 and a backup roller 124. Sheet 102 passes between fuser roller 122 and backup roller 124 with the toner powder image contacting fuser roller 122. In this manner, the toner powder image is permanently affixed to sheet 102 after it is allowed to cool. After transfer of the images to the sheet 102, the sheet has the appearance depicted in FIG. 5. As shown therein the color toner developed on top of the black CAD image on the photoreceptor resides beneath the black toner. The black CAD image appears black irrespective of the color toner beneath it. The black image may actually be enhanced and made darker by the presence of the colored toner. It is known that the printing industry often uses black and magenta inks in combination to achieve higher densities without applying too much ink in any one pass. After fusing, a chute, not shown, guides the advancing sheets 102 to a catch tray (not shown) for subsequent removal from the machine by the operator.

After the sheet of support material 102 is separated from photoconductive surface of belt 10, the residual toner particles carried by the non-image areas on the photoconductive surface are removed therefrom. These particles are removed at cleaning station G. A cleaning housing 66 supports therewithin cleaning brushes, not shown, supported for counter-rotation with respect to the other and each supported in cleaning relationship with photoreceptor belt 10. A preclean device (not shown) for conditioning the photoreceptor prior to cleaning is contemplated.

What is claimed is:

1. A method of creating highlight color images on a charge retentive surface using light/lens optics to scan an original document, said method including the steps of:

moving said charge retentive surface past a plurality of process stations including a charging station where said charge retentive surface is uniformly charged;

using light/lens scanning optics, forming relatively high contrast charged area images in said charge retentive surface, said images corresponding to black images of an original;

using black toner particles, developing said images corresponding to black images;

uniformly recharging said charge retentive surface with said images corresponding to black images thereon;

using light/lens scanning optics and a color filter which causes color images on an original document to appear black on said charge retentive surface, forming relatively high contrast charged area images corresponding to color images of said original;

using colored toner particles, developing said high contrast charged area images corresponding to color images of said original.

2. The method according to claim 1 including the step of transferring black and color images to a final substrate.

3. The method according to claim 2 wherein said black image is formed during a first pass.

4. Apparatus for creating highlight color images on a charge retentive surface using light/lens optics to scan an original document, said apparatus comprising:

means for moving said charge retentive surface past a plurality of process stations including a charging station where said charge retentive surface is uniformly charged;

means including light/lens scanning optics, for forming relatively high contrast charged area images in said charge retentive surface, said images corresponding to black images of an original;

means for, developing said images corresponding to black images with black toner particles;

means for uniformly recharging said charge retentive surface with said images corresponding to black images thereon;

means including light/lens scanning optics and a color filter which causes color images on an original document to appear black on said charge retentive surface, for forming relatively high contrast charged area images corresponding to color images of said original;

means for, developing said high contrast charged area images corresponding to color images of said original with colored toner particles.

5. Apparatus according to claim 4 including means for transferring black and color images to a final substrate.

6. Apparatus according to claim 4 wherein said black image is formed during a first pass.

7. A method of creating highlight color images on a charge retentive surface using light/lens optics to scan an original document, said method including the steps of:

moving said charge retentive surface past a plurality of process stations including a charging station where said charge retentive surface is uniformly charged;

using light/lens scanning optics, forming relatively high contrast charged area images in said charge retentive surface, said images corresponding to black images of an original;

using black toner particles, developing said images corresponding to black images;

uniformly recharging said charge retentive surface with said images corresponding to black images thereon;

using light/lens scanning optics and a color exposure lamp which causes color images on an original document to appear black on said charge retentive surface, forming relatively high contrast charged area images corresponding to color images of said original;

using colored toner particles, developing said high contrast charged area images corresponding to color images of said original.

8. Apparatus for creating highlight color images on a charge retentive surface using light/lens optics to scan an original document, said apparatus comprising:

means for moving said charge retentive surface past a plurality of process stations including a charging station where said charge retentive surface is uniformly charged;

means including light/lens scanning optics, for forming relatively high contrast charged area images in said charge retentive surface, said images corresponding to black images of an original;

means for, developing said images corresponding to black images with black toner particles;

means for uniformly recharging said charge retentive surface with said images corresponding to black images thereon;

means including light/lens scanning optics and a colored exposure lamp which causes color images on an original document to appear black on said charge retentive surface, for forming relatively high contrast charged area images corresponding to color images of said original;

means for, developing said high contrast charged area images corresponding to color images of said original with colored toner particles.

* * * * *